US012458116B2

(12) United States Patent
Feinstein et al.

(10) Patent No.: US 12,458,116 B2
(45) Date of Patent: Nov. 4, 2025

(54) BAND EMPLOYING BISTABLE MAGNETIC ACTUATOR WITH HANDS FREE ACTUATION

(71) Applicant: Peter A Feinstein Patents LLC, Palm Beach Gardens, FL (US)

(72) Inventors: Peter A. Feinstein, Palm Beach Gardens, FL (US); Ivyann Oveson Running, Orem, UT (US); Andrew Geyser, Fort Collins, CO (US); Brian Jensen, Orem, UT (US); Nathan Usevitch, Vineyard, UT (US); Carter Stentzel, San Antonio, TX (US)

(73) Assignee: Peter A Feinstein Patents LLC, Palm Beach Gardens, FL (US)

( * ) Notice: Subject to any disclaimer, the term of this patent is extended or adjusted under 35 U.S.C. 154(b) by 0 days.

(21) Appl. No.: 19/259,097

(22) Filed: Jul. 3, 2025

(65) Prior Publication Data

US 2025/0331613 A1 Oct. 30, 2025

Related U.S. Application Data

(63) Continuation-in-part of application No. 19/076,592, filed on Mar. 11, 2025, now Pat. No. 12,369,695.
(Continued)

(51) Int. Cl.
*A44C 5/14* (2006.01)
*A44C 5/10* (2006.01)

(52) U.S. Cl.
CPC ..... *A44C 5/102* (2013.01); *A44D 2203/00* (2013.01)

(58) Field of Classification Search
CPC ..... A44C 5/08; A44C 5/0053; A44C 5/2071; A44C 5/105; A44C 5/107; A44C 5/12; A44C 5/14; A44C 5/147; A44D 2203/00
See application file for complete search history.

(56) References Cited

U.S. PATENT DOCUMENTS 265,044 A 9/1882 Engelmann
285,041 A 9/1883 King
(Continued)

OTHER PUBLICATIONS

Pece, F., "MagTics: Flexible and Thin Form Factor Magnetic Actuators for Dynamic and Wearable Haptic Feedback"; UIST Oct. 22, 2017 Retrieved on Jan. 28, 2025 from https://www.epfl.ch/labs/lmts/wp-content/uploads/2019/02/mag-tics-uist-lowres.pdf.
(Continued)

*Primary Examiner* — Jack W Lavinder
(74) *Attorney, Agent, or Firm* — Forge IP, PLLC; Todd M. Oberdick

(57) ABSTRACT

A band configured to wrap around and be secured to an object includes at least three members pivotably connected to one another so as to be pivotable between an open position and a closed position, the first member including an outwardly disposed face defining an imaginary plane and each of the second and third members including an actuator prong that extends outwardly beyond the imaginary plane when in the open position and that is retracted to no longer extend outwardly beyond the imaginary plane when in the closed position. Movement of the object into contact with the first member so as to exert actuation forces toward the outwardly disposed face when the actuator prongs are in contact with a surface causes the second and third members to move from the open position to the closed position due to forces created between the actuator prongs and the surface.

20 Claims, 15 Drawing Sheets

Related U.S. Application Data

(60) Provisional application No. 63/564,787, filed on Mar. 13, 2024.

(56) References Cited

U.S. PATENT DOCUMENTS

| | | | | | |
|---|---|---|---|---|---|
| 290,590 | A | | 12/1883 | Lettre | |
| 299,658 | A | * | 6/1884 | Liebel | A44C 5/12 63/8 |
| 300,286 | A | | 6/1884 | Salisbury | |
| 2,009,254 | A | | 7/1935 | Feid | |
| 2,612,302 | A | * | 9/1952 | Dinstman | G04B 37/12 224/174 |
| 2,707,800 | A | | 5/1955 | Popper | |
| 2,780,400 | A | * | 2/1957 | Lancaster | G04B 37/12 224/174 |
| 2,787,893 | A | | 4/1957 | Canning | |
| 3,805,548 | A | | 4/1974 | Matwijcow | |
| 3,940,038 | A | | 2/1976 | Claude | |
| 5,197,046 | A | * | 3/1993 | Siu | G04B 37/1486 224/174 |
| 9,141,086 | B1 | | 9/2015 | Rohrbach | |
| 9,668,550 | B2 | | 6/2017 | Seo et al. | |
| 9,924,766 | B2 | | 3/2018 | De Iuliis et al. | |
| 10,123,608 | B2 | | 11/2018 | Kosoglow et al. | |
| 10,362,855 | B2 | | 7/2019 | Whang et al. | |
| 10,455,900 | B2 | | 10/2019 | Feinstein | |
| 11,428,366 | B2 | | 8/2022 | Ahi | |
| 2003/0116596 | A1 | | 6/2003 | Terasawa | |
| 2006/0048543 | A1 | | 3/2006 | Kessler | |
| 2021/0048841 | A1 | | 2/2021 | Liu | |
| 2024/0188694 | A1 | | 6/2024 | Vartanov et al. | |

OTHER PUBLICATIONS

Pruett, Hunter T., "Actuation and Stabilization of Volume-Efficient Origami-Inspired Mechanisms" (2024); Theses and Dissertations. 10578. https://scholarsarchive.byu.edu/etd/10578.

* cited by examiner

BAND EMPLOYING BISTABLE MAGNETIC ACTUATOR WITH HANDS FREE ACTUATION

FIELD OF THE INVENTION

This disclosure relates generally to bands of material, such as for a watchband or other attachment or fixation system, employing bistable magnetic actuators to achieve a biased-open configuration and a biased-closed configuration of the band.

BACKGROUND OF THE INVENTION

Electronic devices and other apparatuses, such as wearable devices like smart watches, heart rate monitors, or fitness monitors, may be attached to one or more body parts of a user utilizing attachment structures, such as bands. To meet various fitting requirements, it is preferred that wearable bands have open and closed positions, and that is relatively easy for the wearer to switch between the two. It is further preferred that wearable bands, especially those to be worn on a wrist or arm, require very simple one-handed operation. Most preferable would be a wearable band that required no use of the opposite hand other than to position or place the object on the desired location, after which the band is capable of completing the attachment by itself automatically as a hands-free operation upon activation or triggering by the wearer.

Conventional bands, such as watch bands, jewelry bands, magnetic health bands, bracelets, and necklaces, typically include expanding linkages and non-expanding linkages. However, such bands often are very delicate and flimsy and do not hold up well to physical exercise, fitness activities and sports.

Most conventional bands use clasps to open and close the bands. Traditional clasp mechanisms come in various forms. Buckle and tether clasp mechanisms rely on mechanical features to keep the band or flap closed. Buckle and tether mechanisms can provide one-handed operation and can be adjusted, but they are often not easy to use in one handed operation. Hook-and-loop fasteners, such as Velcro®-like fasteners, can be adjusted and opened or closed by one hand, but they are not aesthetically pleasing. Button and hole clasps can be adjustable if there are multiple holes, but they are difficult to operate one-handed and the length adjustment is limited by the locations of the holes. Magnetic closure mechanisms use a post and hole configuration for alignment of the magnetic closure for mechanical retention in shear. Such magnetic closures are operable by one-hand but have limitations when used alone.

Generally, conventional bands with clasps require somewhat complicated manipulation by the wearer, which may make them difficult to wear for those with various disabilities, for the very young, for the very old, etc. Thus, there is still a need to provide an improved wearable band which is suitable for one handed or even hands free operation. Desirably, the wearable band is able to clasp automatically upon putting onto a body with little if any input required for the wearer to activate/trigger the band from the opened to the closed position.

The present invention, therefore, aims to remedy the problems associated with known bands by providing a band, such as a watch band or other wearable band, that is suitable for very simple one handed or hands free operation and that can assemble around a body part upon being positioned onto the body part with little, if any, input required for the wearer to activate/trigger the band from the opened to the closed position.

SUMMARY OF THE INVENTION

The present invention achieves these objectives by providing a band of material, such as for a watchband or other attachment or fixation system, utilizing one or more bistable magnetic actuators to achieve bias opened and bias closed configurations.

It has been proposed to employ bistable magnetic arrangements in connection with bistable hinge designs and the like, with two stable equilibrium positions separated by an unstable equilibrium position. These arrangements gain their bistable behavior from the energy created by permanent magnets and their acting to attract or repel one another depending on the relative positioning between the two. This approach integrates desired mechanism motion and magnetic energy to create bistable arrangements with dramatically reduced part count compared to traditional mechanisms incorporating rigid links, joints, and springs. As a deflection is applied to the arrangement (causing relative movement between the magnets), the arrangement rapidly transitions from one stable position to the other. The force-deflection response for a typical bistable mechanism is illustrated schematically and graphically in FIG. 1A and FIG. 1B.

As can be seen, bistable magnetic arrangements do not require power to be held in either of their stable positions (as indicated at Theta positions of 0° and 180° in FIG. 1B and the corresponding magnet positions in FIG. 1A). As can also be seen, as the magnets are rotated with respect to each other toward a Theta of 90°, forces are created urging the magnets back to their stable 0° position. However, once a Theta of 90° is reached, (note peak of graph), the magnets now start to urge one another toward the second stable position at 180°. Thus, the two stable equilibrium positions are defined at Theta positions of 0° and 180° separated by an unstable equilibrium position (with peak energy storage at a Theta of) 90°.

The present invention incorporates bistable magnetic arrangements to create actuators incorporated into the inventive band of material, such as for a watchband or other wearable band.

In accordance with one particular exemplary embodiment of the present invention, a band configured to wrap around and be secured to an object includes at least three members pivotably connected to one another so as to be pivotable with respect to each other between an open position and a closed position, the first member including an outwardly disposed face defining an imaginary plane and each of the second and third members including an actuator prong that extends outwardly beyond the imaginary plane when the second and third members are in the open position and that is retracted to no longer extend outwardly beyond the imaginary plane when the second and third members are in the closed position. The first and second members are configured such that when the first and second members are pivoted with respect to each other past a threshold position toward the closed position, the first and second members are biased toward the closed position by biasing forces and when the first and second members are pivoted with respect to each other past the threshold position toward the open position, the first and second members are biased toward the open position by biasing forces. The first and third members are configured such that when the first and third members are pivoted with respect to each other past a threshold position toward the closed position, the first and third members are biased toward the closed position by biasing forces and when the first and third members are pivoted with respect to each other past the threshold position toward the open position, the first and third members are biased toward the open position by biasing forces. Movement of the object into contact with the first member so as to exert actuation forces toward the outwardly disposed face when the actuator prongs of the second and third members are in contact with a surface causes the second and third members to move from the open position to the closed position due to forces created between the actuator prongs and the surface.

In some embodiments, a first member of the at least three members comprises a first permanent magnet and a second permanent magnet disposed at opposite ends thereof, a second member of the at least three members comprises a third permanent magnet and a third member of the at least three members comprises a fourth permanent magnet, such that the biasing forces biasing the first and second members toward the closed position and biasing the first and second members toward the open position are created by the first and third magnets and the biasing forces biasing the first and third members toward the closed position and biasing the first and third members toward the open position are created by the second and fourth magnets.

In certain of these embodiments, each of the first, second, third and fourth magnets comprises a diametrically magnetized magnet. In certain embodiments, each of the first, second, third and fourth magnets is configured as a rectangular prism. In certain embodiments, each of the first, second, third and fourth magnets is configured as a cylinder.

In some embodiments, the second and third members are pivotably connected to the first member at opposite ends thereof. In certain of these embodiments, the first member comprises a watch body and the outwardly disposed face comprises a watch face, the second member comprises a first watch strap, and the third member comprises a second watch strap, whereby the band comprises a watch.

In some embodiments, a closure is provided affixing the second member and the third member together when the second and third members are in the closed position. In certain of these embodiments, the closure comprises a magnetic closure.

In some embodiments, at least one of the second member and the third member comprises a flexible material.

In some embodiments, at least one of the second member and the third member comprises a plurality of links. In certain of these embodiments, at least some of the plurality of links comprise bistable compliant links. In certain embodiments, at least some of the plurality of links comprise passive links. In certain embodiments, the plurality of links comprise a combination of bistable compliant links and passive links.

In some embodiments, the open position and the closed position comprise stable positions such that the open position and the closed position are maintained without external forces being applied thereto. In certain of these embodiments, rotational positions of the first and second members with respect to each other and rotational positions of the first and third members with respect to each other between the open position and the closed position comprise unstable positions so as to require external forces to be applied in order to maintain rotational positions of the first and second members with respect to each other and rotational positions of the first and third members with respect to each other between the open position and the closed position.

In some embodiments, the first member comprises a first planar surface and a second planar surface at a first end thereof, the first and second planar surfaces defining an angle therebetween, the first member comprises a third planar surface and a fourth planar surface at a second end thereof, the third and fourth planar surfaces defining an angle therebetween, the second member comprises a planar surface, the third member comprises a planar surface, the planar surface of the second member abuts the first planar surface of the first member when in the open position and the planar surface of the second member abuts the second planar surface of the first member when in the closed position, and the planar surface of the third member abuts the third planar surface of the first member when in the open position and the planar surface of the third member abuts the fourth planar surface of the first member when in the closed position. In certain of these embodiments, the angle between the first and second planar surfaces of the first member is 90 degrees and the angle between the third and fourth planar surfaces of the first member is 90 degrees.

In some embodiments, a first pivot element is configured to allow the first and second members to pivot with respect to one another, while preventing the first and second members from separating, and a second pivot element is configured to allow the first and third members to pivot with respect to one another, while preventing the first and third members from separating.

In accordance with another aspect of the present invention, a band configured to wrap around and be secured to an object includes at least three members pivotably connected to one another so as to be pivotable with respect to each other between an open position and a closed position, the first member comprising an outwardly disposed face defining an imaginary plane and each of the second and third members comprising an actuator prong that extends outwardly beyond the imaginary plane when the second and third members are in the open position and that is retracted to no longer extend outwardly beyond the imaginary plane when the second and third members are in the closed position. A first member of the at least three members comprises a first diametrically magnetized magnet and a second diametrically magnetized magnet disposed at opposite ends thereof, a second member of the at least three members comprises a third diametrically magnetized magnet, and a third member of the at least three members comprises a fourth diametrically magnetized magnet, The first and second members are configured such that when the first and second members are pivoted with respect to each other past a threshold position toward the closed position, the first and second members are biased toward the closed position by forces created by the first and third magnets and when the first and second members are pivoted with respect to each other past the threshold position toward the open position, the first and second members are biased toward the open position by forces created by the first and third magnets. The first and third members are configured such that when the first and third members are pivoted with respect to each other past a threshold position toward the closed position, the first and third members are biased toward the closed position by forces created by the second and fourth magnets and when the first and third members are pivoted with respect to each other past the threshold position toward the open position, the first and third members are biased toward the open position by forces created by the second and fourth magnets. Movement of the object into contact with the first member so as to exert actuation forces toward the outwardly disposed face when the actuator prongs of the second and third members are in contact with a surface causes the second and third members to move from the open position to the closed position due to forces created between the actuator prongs and the surface.

The present invention, as set out above in various respects, provides a band, such as a watch band or other wearable band, that is suitable for very simple one handed or hands free operation and that can assemble around a body part upon being positioned onto the body part with little, if any, input required for the wearer to activate/trigger the band from the opened to the closed position.

Other features and advantages of the invention will become more apparent from consideration of the following drawings and written description.

BRIEF DESCRIPTION OF THE DRAWINGS

FIG. 9A and FIG. 9B are side isometric views of a band, shown respectively in an open position and a closed position, configured in accordance with the present invention, where the band is employed as a cuff closure for medical scrubs or the like;

FIG. 10A and FIG. 10B are side elevational views of a band, shown respectively in an open position and a closed position, configured in accordance with the present invention, where the band is employed as a wrap to secure heat packs, cold packs or the like;

FIG. 11A and FIG. 11B are side isometric views of a band, shown respectively in an open position and a closed position, configured in accordance with the present invention, where the band is employed as a safety tether for a gaming device or the like;

DETAILED DESCRIPTION OF THE INVENTION

Figure 1A:
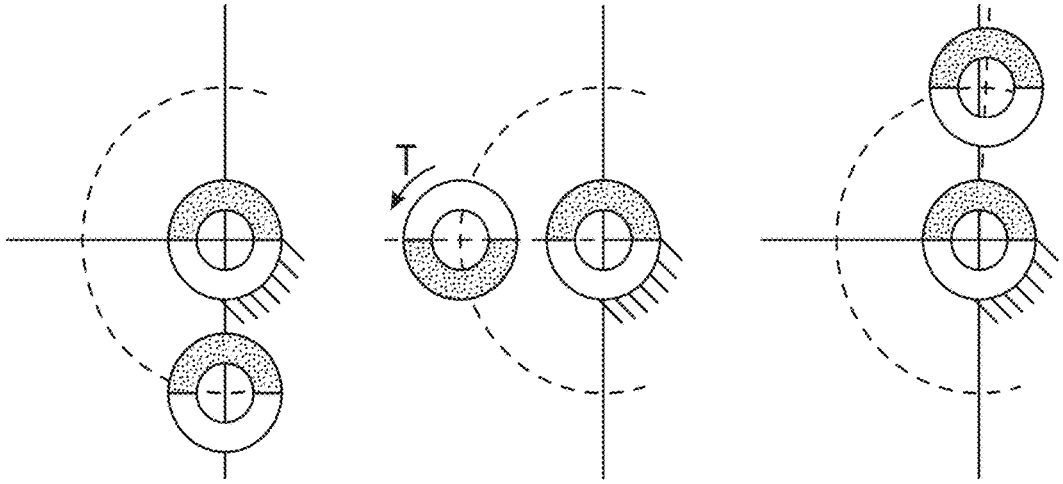
FIG. 1A and FIG. 1B schematically and graphically depict a force-deflection response for an exemplary bistable magnetic arrangement.
Figure 1B:
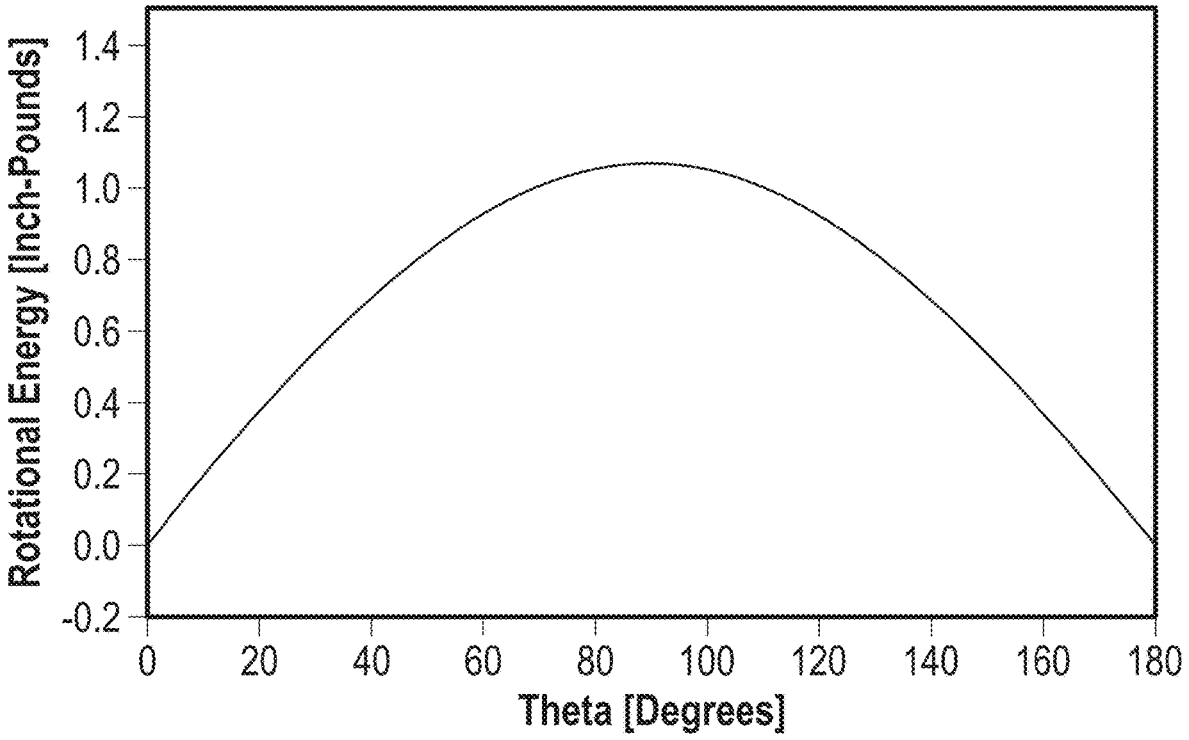
Figure 2:
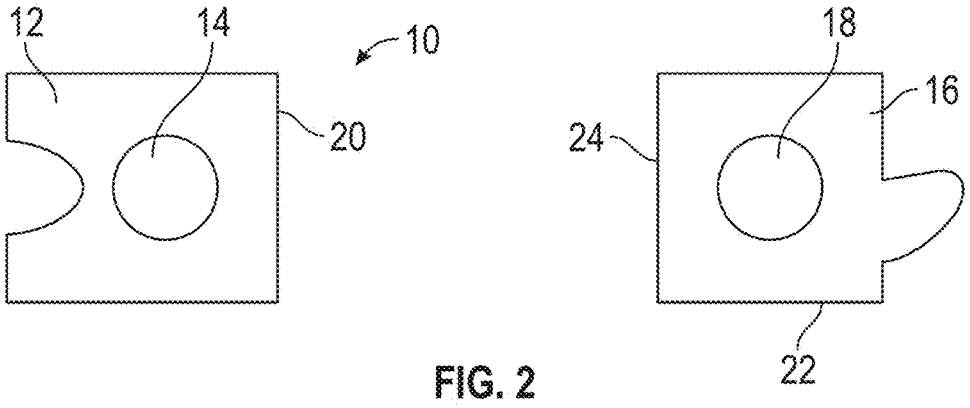
FIG. 2 is a side elevational schematic view of an exemplary embodiment of a bistable magnetic actuator that may be employed by a band configured in accordance with an exemplary embodiment of the present invention.

The present invention may be further understood with reference to the following description and the appended drawings, wherein like elements are referred to with the same reference numerals. Many of the exemplary embodiments of the present invention describe bands used as wearables configured to wrap around a body part (e.g., a wrist, an ankle, etc.) of a wearer. It should be understood, however, that the present invention may be implemented in various other configurations and on various other scales, both smaller and larger than typical wearables.

FIG. 2 and FIGS. 3A-3C generally schematically illustrate a first embodiment of a bistable magnetic actuator (10) that may be employed by a band configured in accordance with exemplary embodiments of the present invention. The actuator (10) includes a first component (12) having a permanent magnet (14) embedded therein and a second component (16) having a permanent magnet (18) embedded therein.

Figure 3A:
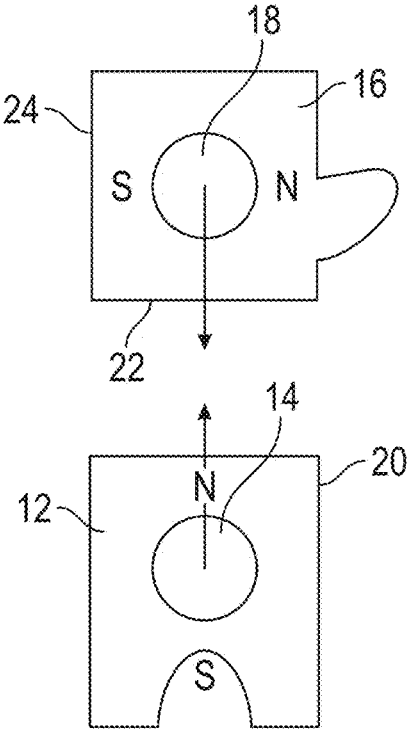
FIGS. 3A-3C are side elevational schematic views of the magnetic actuator of FIG. 2 illustrating the actuator in the stable open position (FIG. 3A), the stable closed position (FIG. 3C) and the intermediate unstable position (FIG. 3B)
Figure 3B:
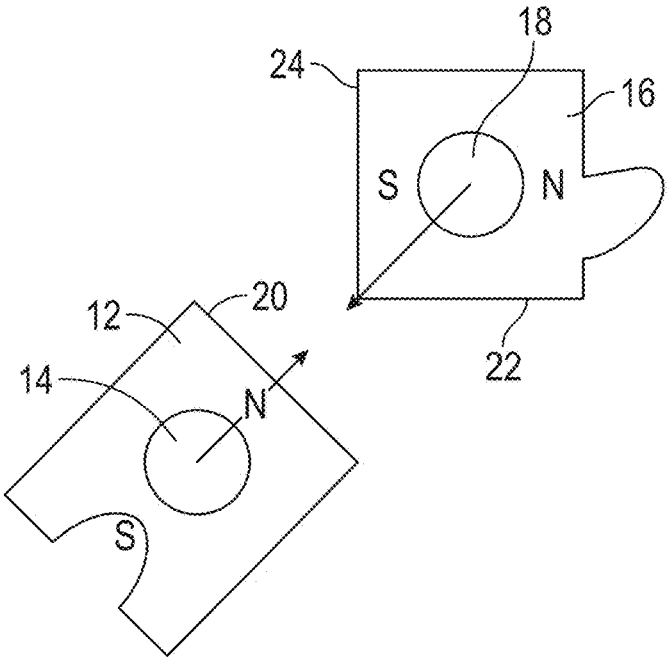
Figure 3C:
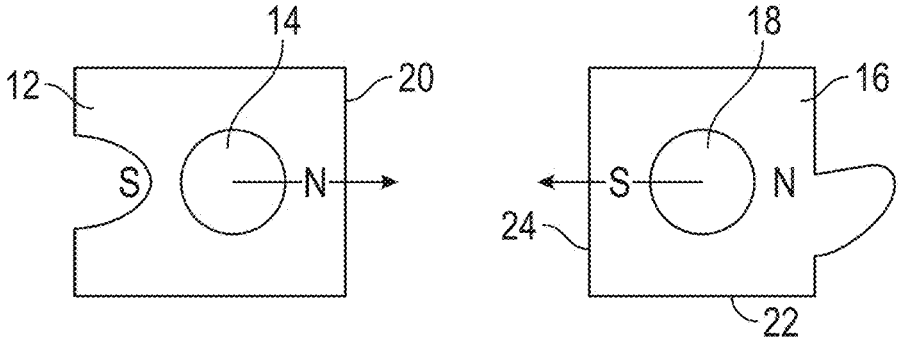

The first and second components (12, 16) are configured such that when the first and second components (12, 16) are pivoted with respect to each other past a threshold position (shown in FIG. 3B) toward a first stable position (shown in FIG. 3A), the first and second components (12, 16) are biased toward the first stable position by forces created by the magnets (14, 18) (indicated by arrows in FIG. 3A) and when the first and second components (12, 16) are pivoted with respect to each other past the threshold position (shown in FIG. 3B) toward the second stable position (shown in FIG. 3C), the first and second components (12, 16) are biased toward the second stable position by forces created by the magnets (14, 18) (indicated by arrows in FIG. 3C).

This biasing configuration can be achieved by providing the first component (12) with a planar surface (20) and providing the second component (16) with a first planar surface (22) and a second planar surface (24), with the first and second planar surfaces (22, 24) defining an angle therebetween. As can be seen in FIG. 3A, when the planar surface (20) of the first component (12) abuts the first planar surface (22) of the second component (16), the first and second components (12, 16) are in the first stable position and as can be seen in FIG. 3C, when the planar surface (20) of the first component (12) abuts the second planar surface (24) of the second component (16), the first and second components (12, 16) are in the second stable position.

While the angle between the first and second planar surfaces (22, 24) of the second component (16) are illustrated as defining an angle therebetween of about 90 degrees, it should be understood that this angle can be smaller or larger than 90 degrees. It is also contemplated that more than two stable positions can be achieved, for example, by providing the second component (16) with more than two planar surfaces (e.g., three planar surfaces separated from one another by 45 degrees would provide three stable positions).

As should be apparent from FIG. 3A and FIG. 3C, the first and second stable positions can be maintained without external forces being applied to the first and second components (12, 16). As best seen in FIG. 3B, on the other hand, it should be recognized that rotational positions of the first and second components (12, 16) with respect to each other between the two stable positions shown in FIG. 3A and FIG. 3C comprise unstable positions so as to require external forces to be applied in order to maintain rotational positions of the first and second components (12, 16) with respect to each other.

Figure 4A:
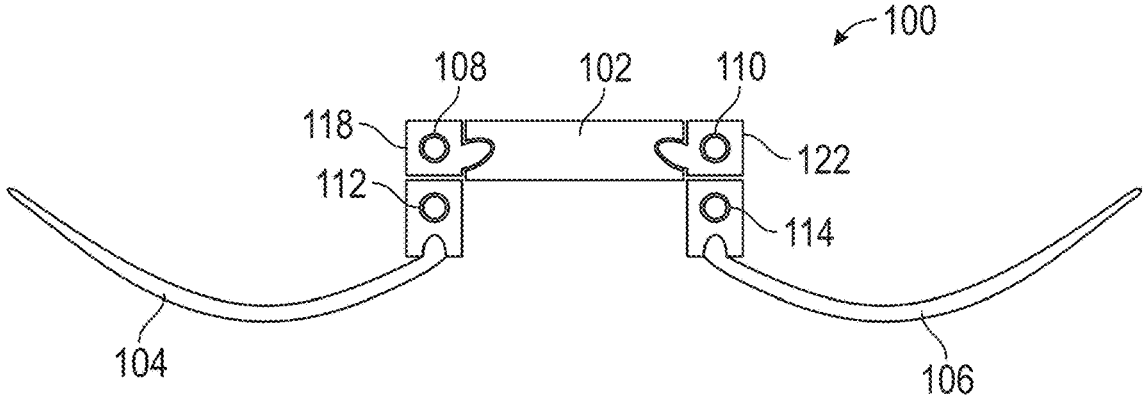
FIGS. 4A-4C are side elevational views of a watch incorporating a band configured in accordance with an exemplary embodiment of the present invention incorporating a pair of the magnetic actuators of FIG. 2 illustrating the actuators in the stable open position (FIG. 4A), the stable closed position (FIG. 4C) and the intermediate unstable position (FIG. 4B)
Figure 4B:
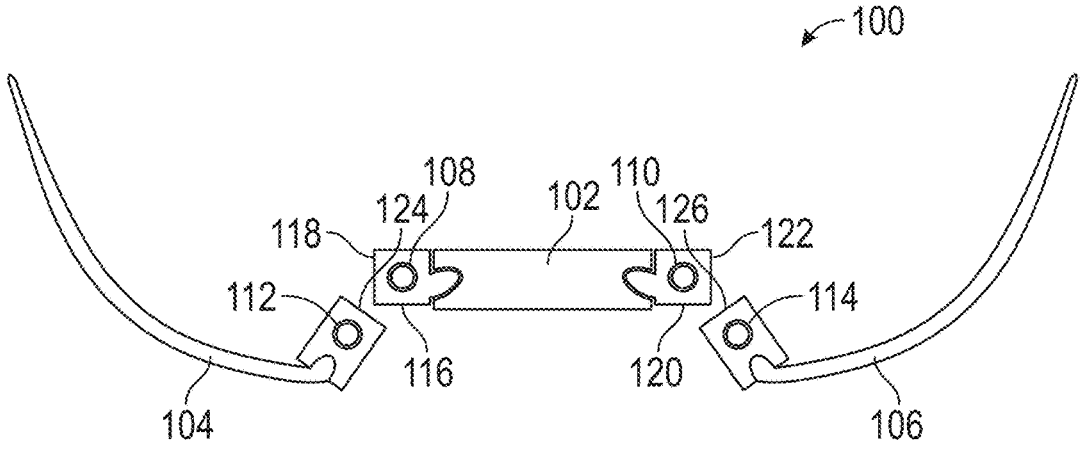
Figure 4C:
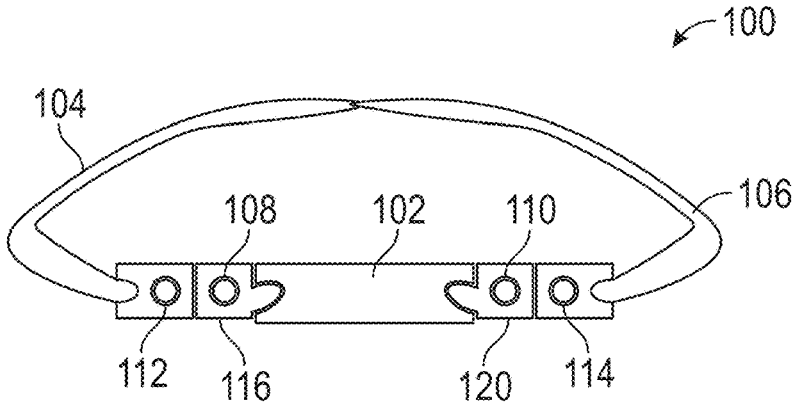

Referring now to FIGS. 4A-4C, a band (100) configured to wrap around and be secured to an object (not shown) in accordance with one particular exemplary embodiment of the present invention includes a pair of bistable magnetic actuators, as illustrated in FIG. 2 and FIGS. 3A-3C.

As shown, the band (100) includes three members (102, 104, 106) pivotably connected to one another so as to be pivotable with respect to each other between an open position (shown in FIG. 4A) and a closed position (shown in FIG. 4C). The second member (104) and the third member (106) are pivotably connected to the first member (102) at opposite ends thereof. In the particular illustrated embodiment, the first member (102) is shown to comprise a watch body, while the second member (104) is shown to comprise a first watch strap, and the third member (106) is shown to comprise a second watch strap, whereby the band (100) comprises a watch. However, it must be recognized that such is not required, and it is contemplated that the band (100) may take any of numerous forms, some other examples of which are described in more detail below.

The first member (102) comprises a first permanent magnet (108) and a second permanent magnet (110) disposed at opposite ends thereof, the second member (104) comprises a third permanent magnet (112) disposed at an end thereof and the third member (106) comprises a fourth permanent magnet (114) disposed at an end thereof. Any of various known or subsequently developed types of permanent magnets may be employed by the present invention, including ceramic magnets, alnico magnets, samarium cobalt magnets, and neodymium iron boron magnets. Moreover, the size and shape of the magnets may be varied as appropriate for the particular application, with generally cylindrical magnets being shown in FIGS. 4A-4C, and with generally rectangular magnets being shown in various other Figures.

Additionally, it should be recognized that one of the first permanent magnet (108) and the cooperating third permanent magnet (112) may be replaced with a ferrous material, and similarly that one of and the second permanent magnet (110) and the cooperating fourth permanent magnet (114) may be replaced with a ferrous material. While providing two cooperating permanent magnets generally provides stronger attraction forces, in situations where such stronger forces are not necessary, use of ferrous materials in one of the cooperating members may provide sufficient results.

The first member (102) and second member (104) are configured such that when the first and second members (102, 104) are pivoted with respect to each other past a threshold position (shown in FIG. 4B) toward the closed position (shown in FIG. 4C), the first and second members (102, 104) are biased toward the closed position (shown in FIG. 4C) by forces created by the first and third magnets (108, 112) and when the first and second members (102, 104) are pivoted with respect to each other past the threshold position (shown in FIG. 4B) toward the open position (shown in FIG. 4A), the first and second members (102, 104) are biased toward the open position (shown in FIG. 4A) by forces created by the first and third magnets (108, 112). Similarly, the first member (102) and the third member (106) are configured such that when the first and third members (102, 106) are pivoted with respect to each other past a threshold position (shown in FIG. 4B) toward the closed position (shown in FIG. 4C), the first and third members (102, 106) are biased toward the closed position (shown in FIG. 4C) by forces created by the second and fourth magnets (110, 114) and when the first and third members (102, 106) are pivoted with respect to each other past the threshold position (shown in FIG. 4B) toward the open position (shown in FIG. 4A), the first and third members (102, 106) are biased toward the open position (shown in FIG. 4A) by forces created by the second and fourth magnets (110, 114).

Similar to above, this biasing configuration can be achieved by providing the first member (102) with a first planar surface (116) and a second planar surface (118) at a first end thereof, the first and second planar surfaces (116, 118) defining an angle therebetween, and a third planar surface (120) and a fourth planar surface (122) at a second end thereof, the third and fourth planar surfaces (120, 122) defining an angle therebetween. The second member (104) and the third member (106) are also provided with their own planar surfaces (124, 126).

As can be seen in FIG. 4A, when the planar surface (124) of the second member (104) abuts the first planar surface (116) of the first member (102), and the planar surface (126) of the third member (106) abuts the third planar surface (120) of the first member (102), the first, second and third members (102, 104, 106) are in a stable, open position and as can be seen in FIG. 4C, when the planar surface (124) of the second member (104) abuts the second planar surface (118) of the first member (102), and the planar surface (126) of the third member (106) abuts the fourth planar surface (122) of the first member (102), the first, second and third members (102, 104, 106) are in a stable, closed position.

While the angle between the first and second planar surfaces (116, 118) of the first member (102) and the angle between the third and fourth planar surfaces (120, 122) of the first member (102) are illustrated as defining angles therebetween of about 90 degrees, it should be understood that these angles can be smaller or larger than 90 degrees. It is also contemplated that more than two stable positions can be achieved, for example, by providing the ends of the first member (102) with more than two planar surfaces (e.g., three planar surfaces separated from one another by 45 degrees would provide three stable positions).

As should be apparent from FIG. 4A and FIG. 4C, the open and closed positions, being stable positions, can be maintained without external forces being applied to the first, second and third members (102, 104, 106). As best seen in FIG. 4B, on the other hand, it should be recognized that rotational positions of the second and third members (104, 106) with respect to the first member (102) between the two stable positions shown in FIG. 4A and FIG. 4C comprise unstable positions so as to require external forces to be applied in order to maintain rotational positions of the second and third members (104, 106) with respect to the first member (102).

Figure 5A:
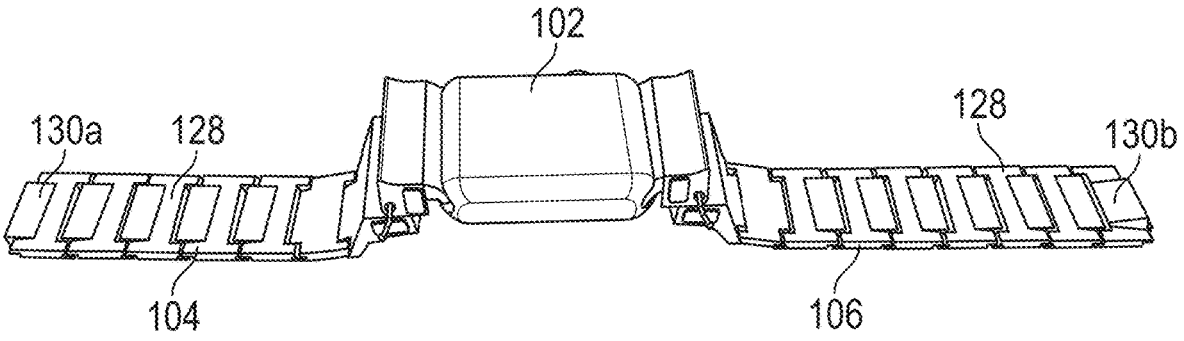
FIG. 5A and FIG. 5B are side isometric views of a watch incorporating a band configured in accordance with an exemplary embodiment of the present invention incorporating a pair of the magnetic actuators of FIG. 2, with the band being defined by a plurality of links and a closure, illustrating the actuators in the stable open position (FIG. 5A) and the stable closed position (FIG. 5B).
Figure 5B:
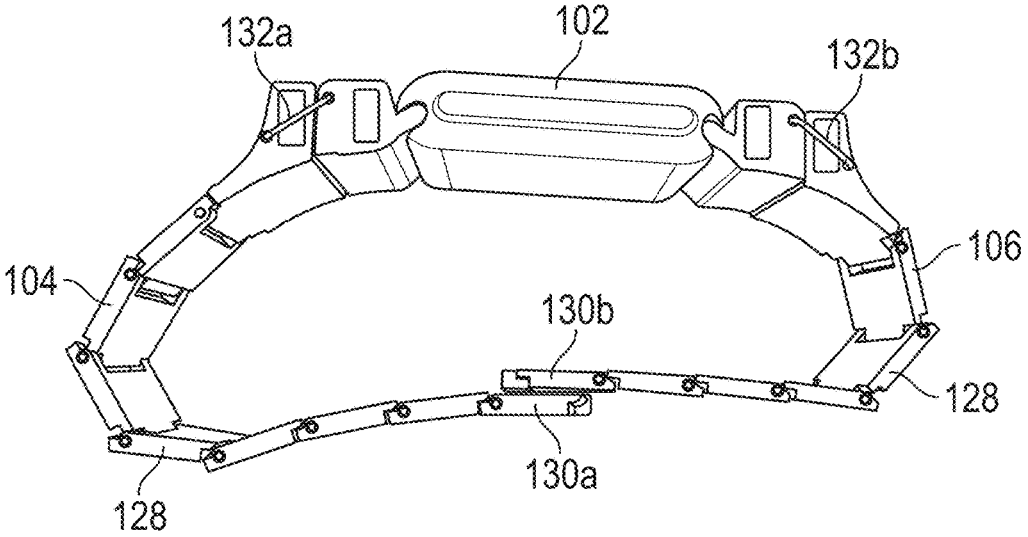
Figure 6:
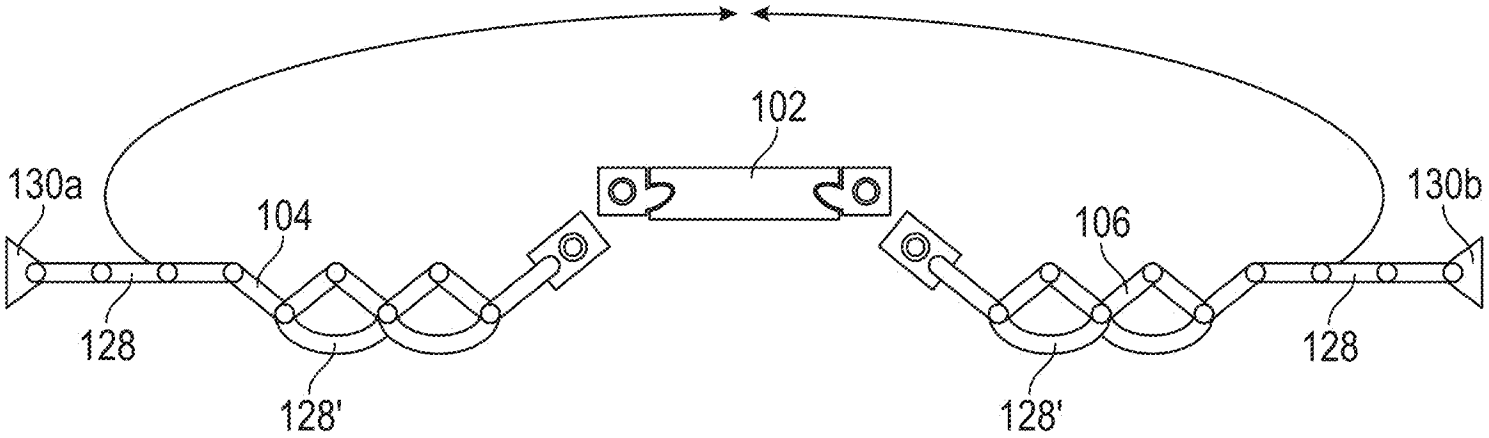
FIG. 6 is a side elevational view of a watch incorporating a band configured in accordance with an exemplary embodiment of the present invention incorporating a pair of the magnetic actuators of FIG. 2, with the band being defined by a plurality of bistable compliant links combined with a plurality of passive links and a closure.
Figure 7:
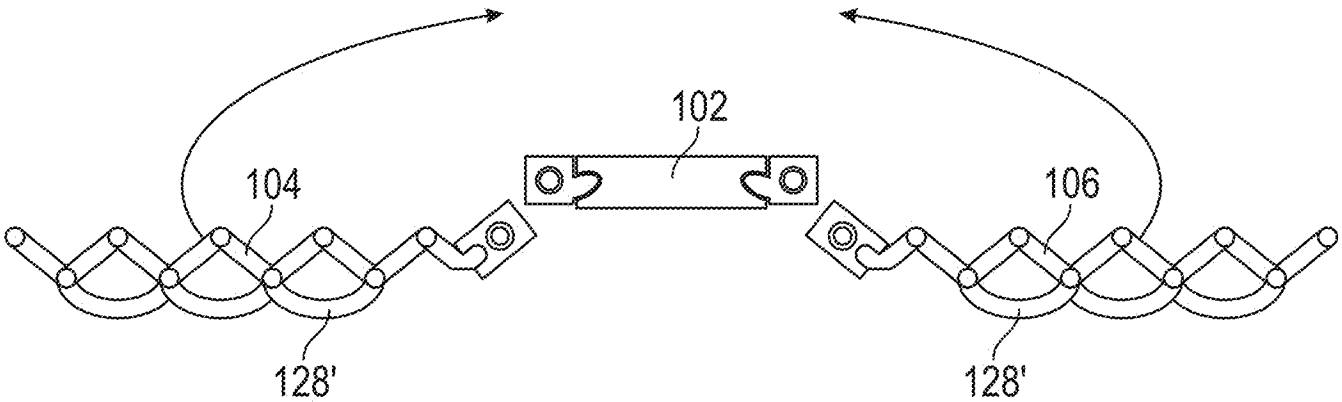
FIG. 7 is a side elevational view of a watch incorporating a band configured in accordance with an exemplary embodiment of the present invention incorporating a pair of the magnetic actuators of FIG. 2, with the band being defined by a plurality of bistable compliant links and no closure.

As shown in FIGS. 4A-4C, the second and third members (104, 106) may comprise a strap of flexible material, such as leather, fabric, silicone, rubber or the like. Instead, or in addition, the second and third members (104, 106) may comprise a plurality of links (128, 128') as shown in FIGS. 5A-5B, FIG. 6 and FIG. 7, such that the magnetic actuators, as discussed above, are used to trigger the opening and/or closing of the straps upon activation by a wearer, thereby facilitating one-handed operation. The links may take the form of passive links (128), as are commonly known (as shown in FIG. 5A and FIG. 5B). If desired, however, the links may take the form of active links (128'), such as being spring biased or biased by operation of bistable compliant mechanisms, as shown and described in our copending U.S. patent application Ser. No. 19/076,629, filed concurrently herewith (as shown in FIG. 7). Additionally, a combination of both passive links (128) and active links (128')—e.g., links employing the use of bistable compliant mechanisms—can be provided, as shown in FIG. 6.

Also as shown in FIG. 5A, FIG. 5B and FIG. 6, the second and third members (104, 106) may be provided with a clasp or closure mechanism (130*a*, 130*b*) at ends thereof opposite to their ends pivotably connected to the first member (102), so as to provide for affixing of the second member (104) and the third member (106) together when the second and third members (104, 106) are in the closed position (shown in FIG. 5B). The clasp/closure (130*a*, 130*b*) may take the form of a magnetic closure or the like, although such is not required.

Also as best seen in FIG. 5B, a first pivot element (132*a*) is provided, which is configured to allow the first and second members (102, 104) to pivot with respect to one another, while preventing the first and second members (102, 104) from separating, while a second pivot element (132*b*) is provided, which is configured to allow the first and third members (102, 106) to pivot with respect to one another, while preventing the first and third members (102, 106) from separating. The first and second pivot elements (132*a*, 132*b*) may take any of numerous forms, such as spring clips having an extended u-shaped, square-backed cross section, as pictured. Of course, other options will be readily apparent to those skilled in the art.

It is contemplated that the first, second and third members (102, 104, 106) configured in accordance with the present invention can be employed in a wide variety of applications. As discussed above in detail, FIGS. 4A-7 show embodiments where the first member (102) comprises a watch body and where the second and third members (104, 106) comprise straps for a watch band, such that the invention is implemented in a watch. However, many other applications are envisioned. Moreover, it is contemplated that more than three members may be employed. For example, there may be provided multiple double-sided members, similar to the first member (102) connected end-to-end between two single ended members, similar to second and third members (104, 106) in order to define an elongated and flexible band, such as an article of jewelry (e.g., a bracelet). Several further exemplary embodiments for use in various applications are now discussed.

Figure 8A:
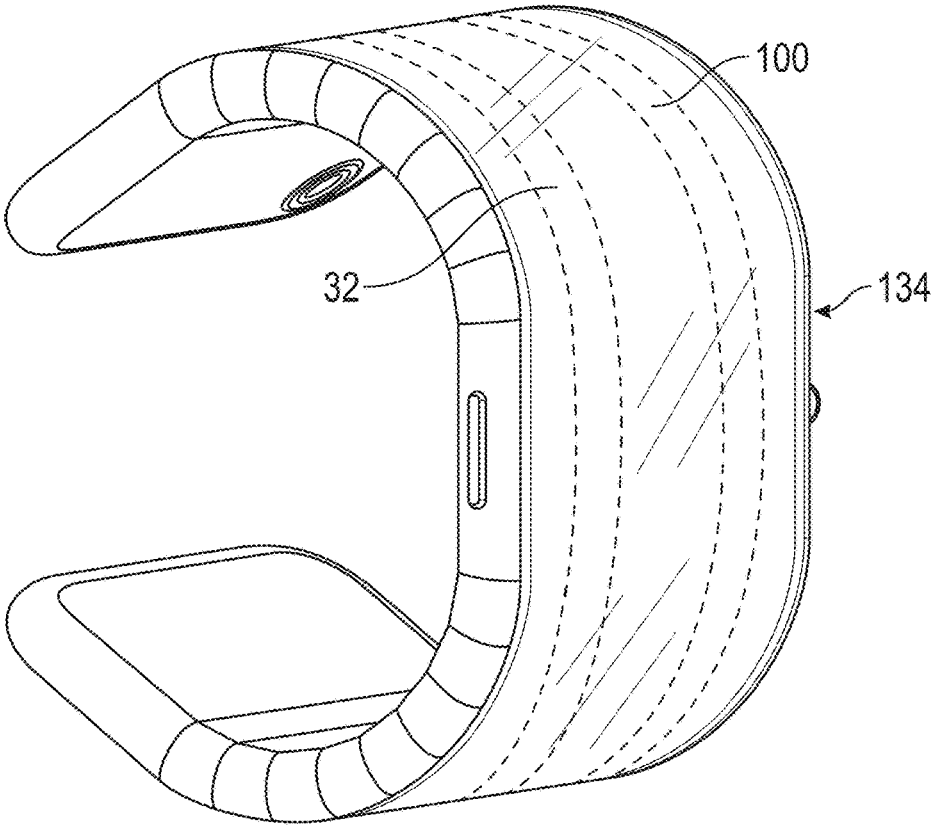
FIG. 8A and FIG. 8B are side isometric views of a flexible mobile communications device, such as a mobile phone, adapted to wrap around a body part, shown respectively alone and as applied to the wrist of a wearer, incorporating at least one band configured in accordance with the present invention.
Figure 8B:
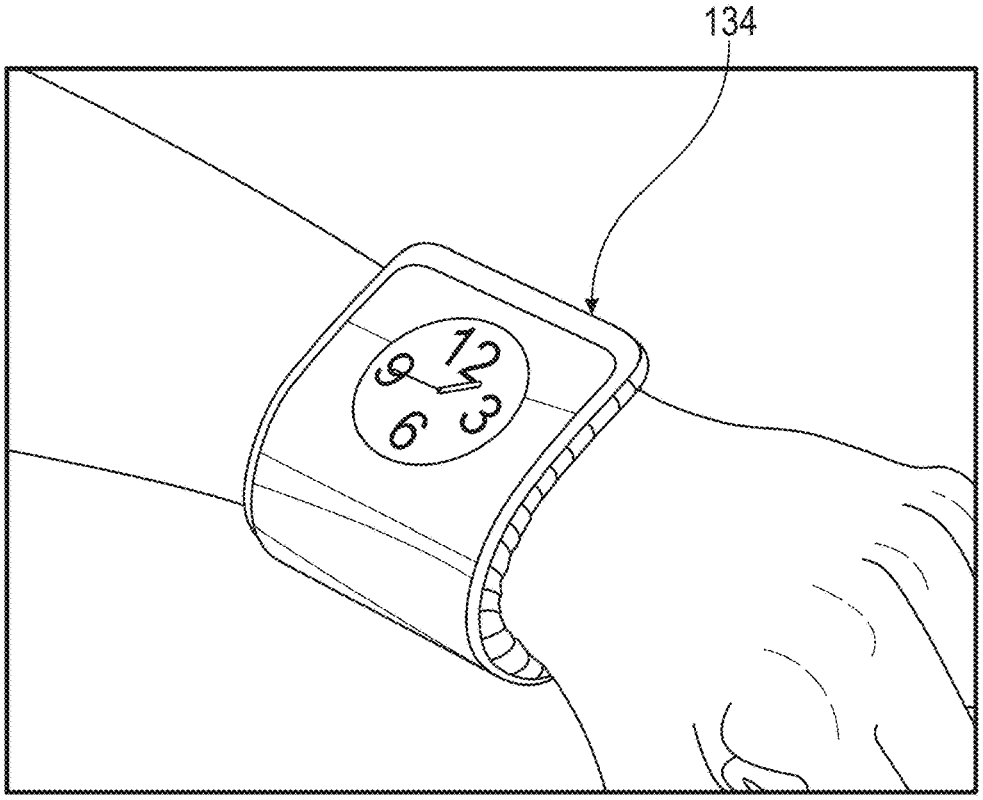

FIG. 8A shows two bands (100) configured in accordance with the present invention embedded into (as indicated by dashed lines) a flexible mobile communications device (134), such as a flexible mobile phone. The bands (100) are adapted to allow the flexible mobile communications device (134) to be wrapped around a body part, such as a wrist, and secure it in place (as shown in FIG. 8B). Two bands (100) are illustrated, although it should be understood that a single band, or more than two bands, may be employed. It is also contemplated that one or more bands according to the present invention may be attached externally to a mobile communications device, as if the device was a large watch. In such instance (i.e., an external closure maintenance mechanism), the band(s) may be provided with or without a clasp, closure or the like, as discussed herein with respect to watch band embodiments. This would allow the wearer to position/anchor/affix the mobile communications device to the wrist once the device is bent into an appropriate position.

Figure 9A:
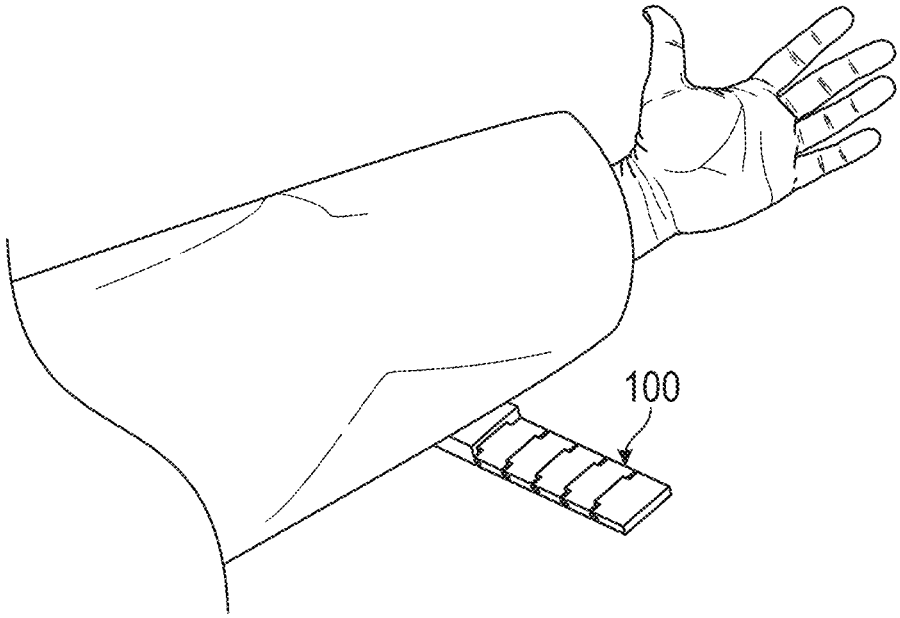
Figure 9B:
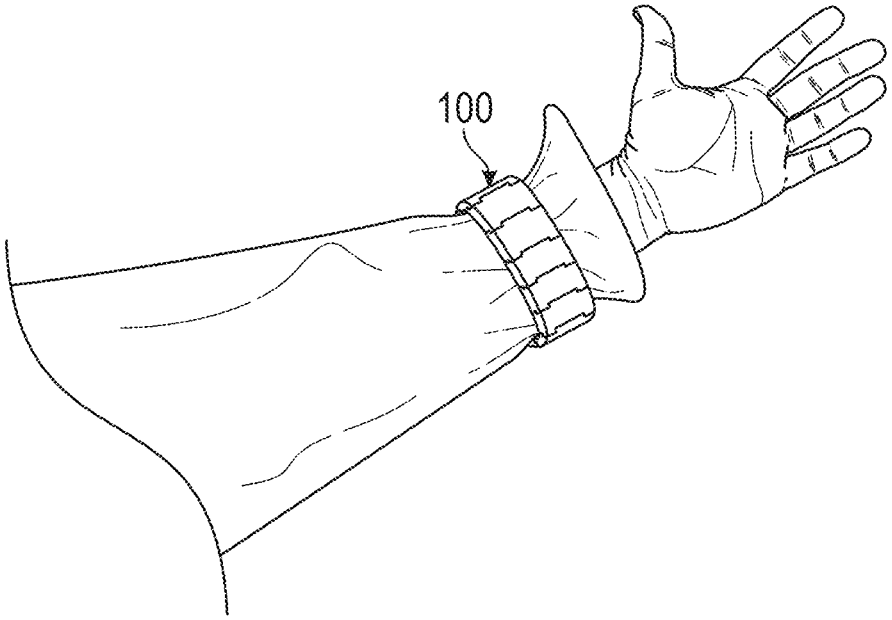

It is also contemplated to employ that the bands (100) configured in accordance with the present invention in connection with a wide variety of medical applications. For example, a band (100) according to the present invention may be used as a cuff attachment to secure and hold the cuffs of medical scrubs around the wrists of a wearer, as shown in FIG. 9A and FIG. 9B. Other similar, non-medical, applications are also contemplated. For example, the bands (100) can be incorporated into smart clothing, such as belts, shirts, or pants or clothing needed under special, environmental conditions, such as space or fire suits, to facilitate personalized fitting in combination with or as an alternative to elastic or hook-and-loop (i.e., Velcro®) type fasteners.

Figure 10A:
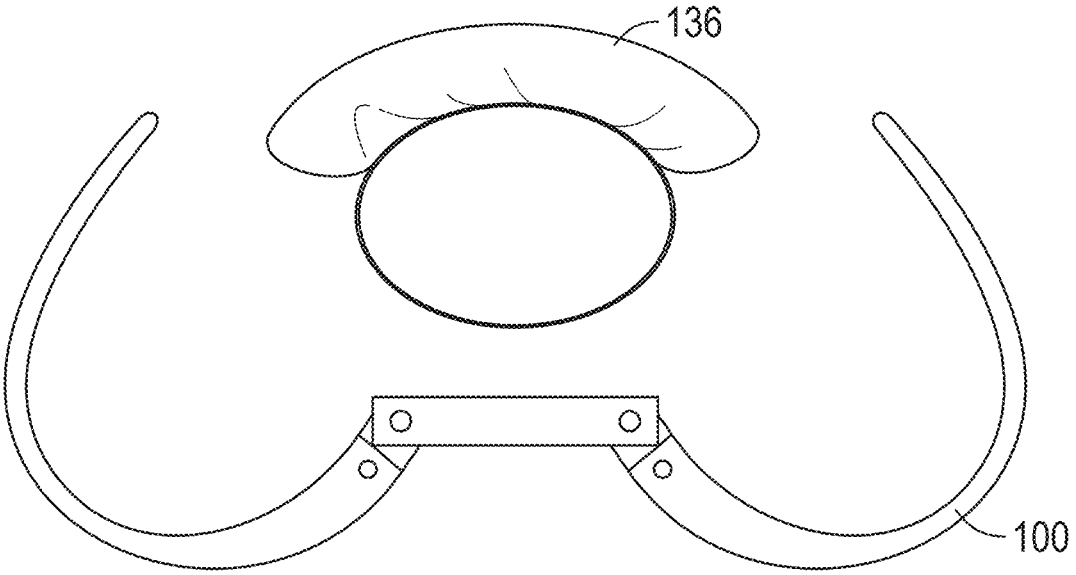
Figure 10B:
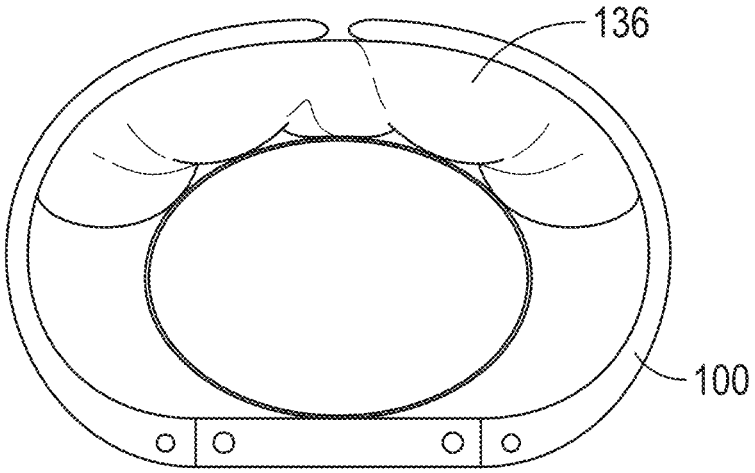

Another medical application is shown in FIG. 10A and FIG. 10B, wherein a plurality of heat or cold packs (136) or the like may be affixed to a body part, such as an upper or lower extremity, by employing one or more bands (100) according to the present invention. In other examples of medical uses, one or more bands (100) in accordance with the present invention may be employed in connection with compression bandages, blood pressure cuffs, etc.

Figure 11A:
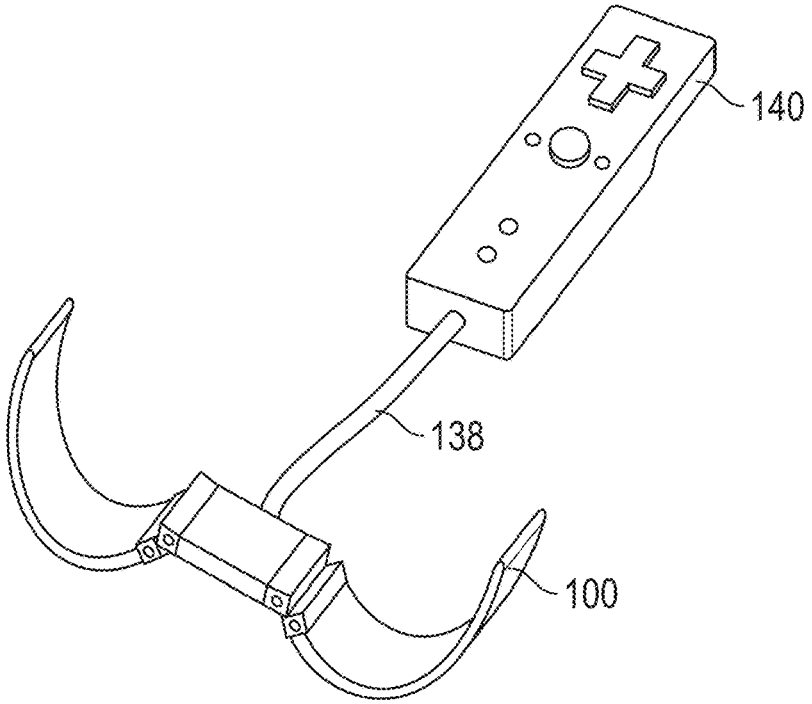
Figure 11B:
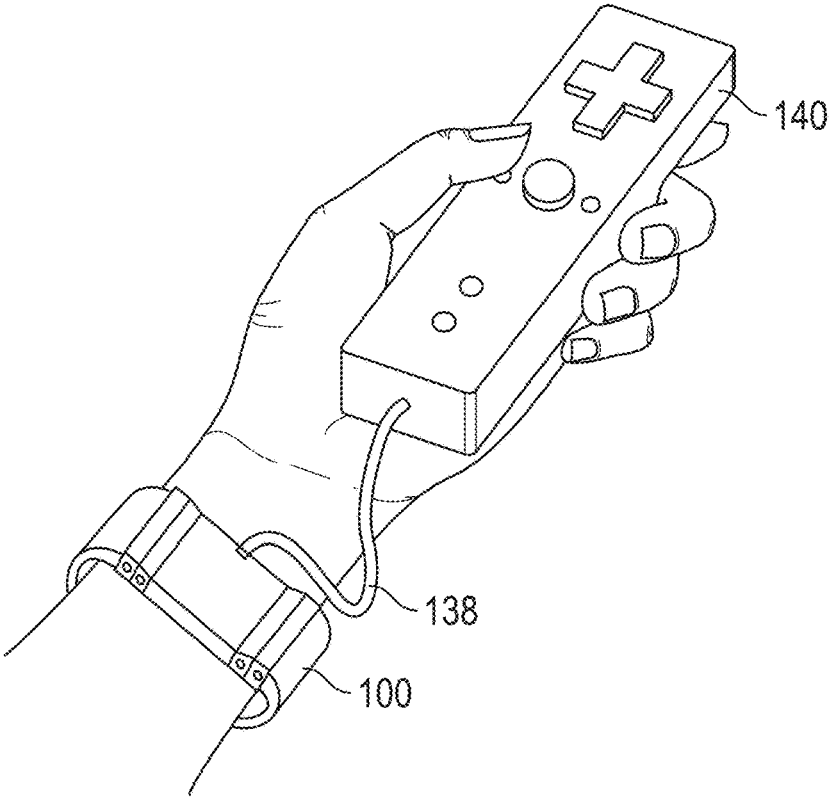

FIG. 11A and FIG. 11B show another exemplary use, wherein a band (100) in accordance with the present invention may be used in connection with a safety tether (138) for a gaming device (140) to attach the device to a player's wrist, such that it is not accidentally thrown during gameplay.

While most of the aforementioned uses contemplated for bands (100) in accordance with the present invention involve use as a wearable of some kind (i.e., a device configured to be wrapped around a body part), it is also envisioned that the bands (100) may be used in significantly different applications.

Figure 12A:
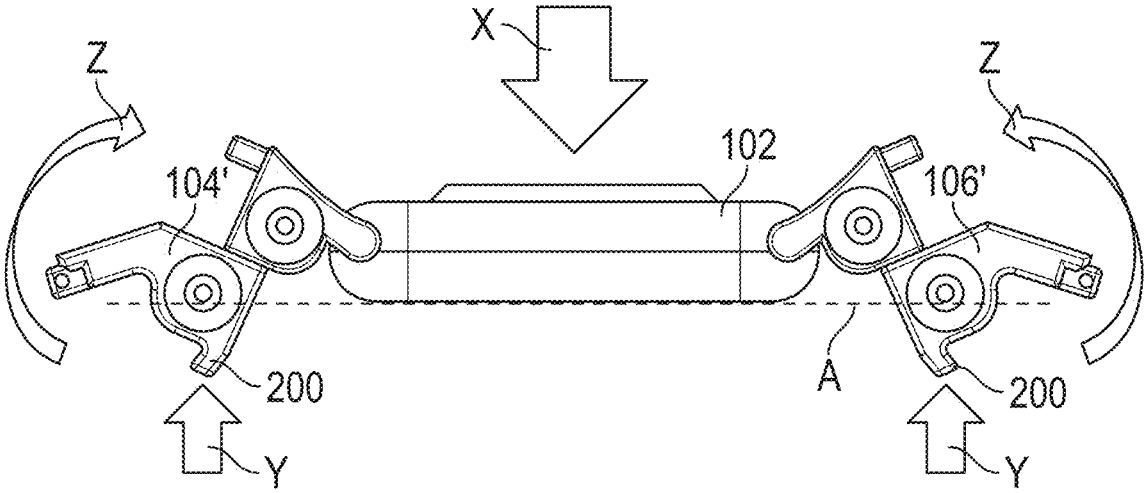
FIG. 12A and FIG. 12B are side elevational views of portions a band, shown respectively in an open position and a closed position, configured in accordance with another exemplary embodiment of the present invention, where the band incorporates an improved hands-free actuation mechanism.
Figure 12B:
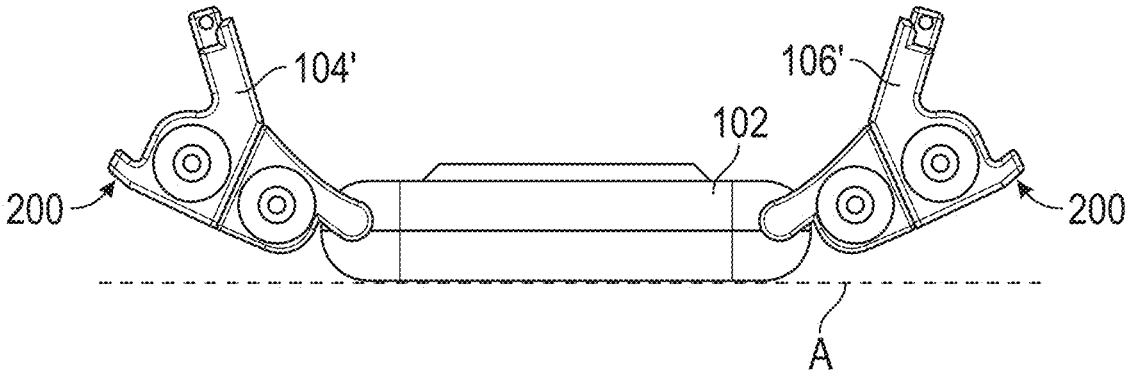
Figure 13A:
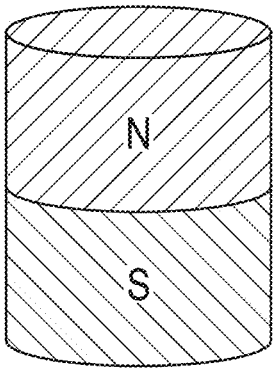
FIG. 13A and FIG. 13B are side isometric views of magnets that may be used in connection with the present invention shaped as, respectively, a cylinder and a rectangular prism, and having a traditional magnetization configuration.
Figure 13B:
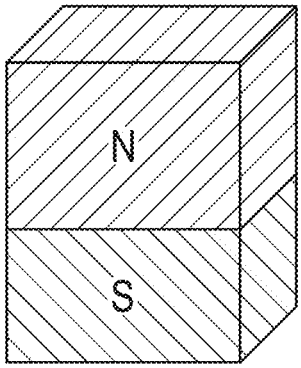
Figure 14A:
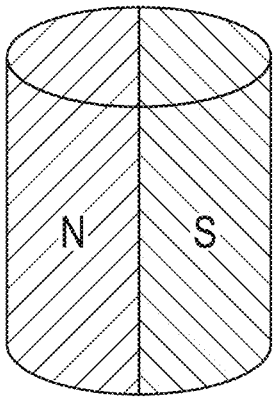
FIG. 14A and FIG. 14B are side isometric views of magnets that may be used in connection with the present invention shaped as, respectively, a cylinder and a rectangular prism, and having a diametrically magnetized configuration.
Figure 14B:
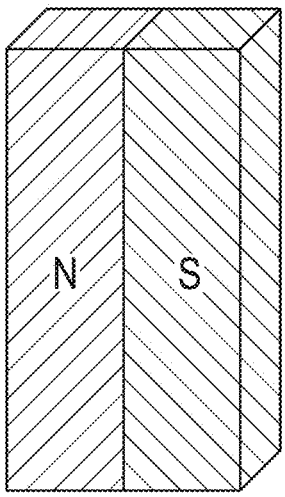

Referring now to FIG. 12A and FIG. 12B, a watch incorporating an actuation mechanism similar to those discussed above in connection with FIGS. 4A-C and FIGS. 5A-B is shown. The embodiment shown in FIG. 12A and FIG. 12B differs from the embodiments shown above, however, in that an improved hands-free actuation mechanism is provided.

More specifically, each of the bands (104', 106') includes an actuator prong (200) extending therefrom and configured such that each actuator prong (200) extends outwardly beyond an imaginary plane (A) defined by the outwardly disposed face of the watch body (102) when the bands (104', 106') are in the open position (as shown in FIG. 12A) and such that the actuator prongs (200) are retracted to no longer extend outwardly beyond the imaginary plane (A) when the bands (104', 106') are in the closed position (as shown in FIG. 12B).

The actuator prongs (200) are sized and shaped so as to raise the outwardly disposed face of the watch body (102) above a table or other horizontal surface when the watch is placed thereon in the open position (shown in FIG. 12A). Movement of the wearers' wrist into contact with the inwardly disposed surface of the watch body (102) exerts actuation forces toward the outwardly disposed face (indicated by arrow X) when the actuator prongs (200) of the bands (104', 106') are in contact with the table or other surface. Consequent forces (indicated by arrows Y) are created between the table or other horizontal surface and the actuator prongs (200), thereby causing the bands (104', 106') to move from the open position (shown in FIG. 12A) to the closed position (shown in FIG. 12B), as indicated by arrows Z, in order to engage the wearer's wrist and secure the watch thereto.

The precise nature of how the bands (104', 106') achieve such biased movement between the open and closed positions is discussed in more detail in connection with the above embodiments.

In this way, the actuator prongs (200) facilitate one-handed donning of the watch, by helping to ensure that the bands (104', 106') are actuated beyond the threshold position necessary to cause movement to the closed position by a simple movement of the wrist into contact with the inwardly disposed surface of the watch body (102).

Turning now to a more detailed discussion of design considerations, the geometry of the actuation mechanism is a critical design parameter, directly influencing the energy required for actuation based on the user's input. In a preferred embodiment, the complete watchband assembly consists of two bands attached on either side of the watchface. Each band contains the actuator, passive links that the actuator flicks, and a magnetic clasp to secure the links once actuated around the wrist. A key consideration is the trade-off between the height of the watch face in its opened state (off of the wrist) and the slimness of the watchband in its closed state (wrapped around the wrist). A higher stowed position allows for a greater energy input during actuation, yet this can conflict with the need for a low profile while being worn. Presented below is an exploration of the selection of magnetic components and various cam geometries to identify configurations that effectively balance these competing requirements and present the final choices made for the watchband design shown in FIGS. 12A and 12B.

Multiple magnetic components were explored to determine the best geometry and magnetization orientation as shown in FIGS. 13A, 13B, 14A and 14B. The primary criterion for magnet selection was the capacity to generate sufficient force to actuate the watchband, while still being practical for use in a watchband. Axially magnetized round magnets (FIG. 13A), diametrically magnetized round magnets (FIG. 14A), and rectangular magnets with face-to-face magnetization (FIG. 14B) or end-to-end magnetization (FIG. 13B) were considered. While the rectangular magnets (FIGS. 13B and 14B) provided the necessary actuation force, their relatively large size was geometrically impractical for integration into a watchband design. Conversely, the round magnets (FIGS. 13A and 14A) offered a more compact and visually beneficial form factor suitable for a wearable application. Among the round magnet configurations, the axially magnetized variants (FIG. 13A) exhibited insufficient magnetic force to trigger the actuation mechanism due to a constant force profile at all orientations-bistable actuators require a varying force profile. However, the diametrically magnetized round magnets (FIG. 14A) demonstrated a promising combination of a small footprint and the required magnetic force profile. Their magnetic force increases in two positions separated by a 90-degree rotation, creating a bistable mechanism (see FIGS. 15A-15C). Ultimately, the diametrically magnetized round magnets are most preferred due to their optimal balance of size and magnetic bistability.

The geometry of the cam mechanism significantly influences both the energy input required for actuation and the overall profile of the watchband. Initial explorations considered simple rectangular geometries for the cam, as seen in FIGS. 2-7. While straightforward to implement, these designs often resulted in a bulky deployed configuration, contradicting the need for a slim profile desirable in a wearable device. Variations incorporating prongs were also investigated as seen in FIGS. 12A and 12B. Extending these prongs had the effect of raising the watch face further off the table in the stowed state, thereby increasing the potential energy input for actuation (as discussed in more detail above). However, this extension also increased the linear distance the watch face needed to be moved to achieve full actuation. Furthermore, the attachment point between the actuation mechanism and the watch face required a sufficiently sharp angle to ensure that the mechanism protruded below the watch face when resting on a flat surface. This protrusion is critical for allowing the user to apply the necessary force to initiate the hands-free actuation. Ultimately, the design process necessitated a cam geometry that balanced a minimal deployed footprint for user comfort, a practical actuation distance in the stowed state, and fulfilled the geometric requirements for reliable, hands-free operation.

A passive band utilizes the energy released by the cam system to wrap around the wrist, and then serves as a watchband during wear. A common type of watchband consists of rigid metal segments connected by pin joints. We developed a modified band that allows the watch to bend around the wrist in one direction, but cannot bend beyond a straight line in the other direction, as discussed in more detail below. This one-way compliance is achieved by adding a series of hard-stops to each of the rigid links.

After the band has wrapped around the wrist, a clasping system must hold it securely in place. We achieve this through a magnetic clasping mechanism, as discussed more fully above.

Figure 15A:
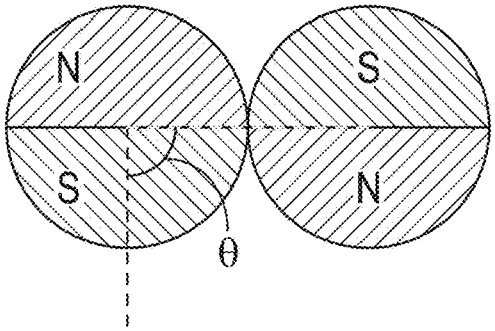
FIGS. 15A-15C are schematic views illustrating cooperation between a pair of diametrically magnetized cylinder magnets, as shown in FIG. 14A, in various positions when used as part of the present invention.
Figure 15B:
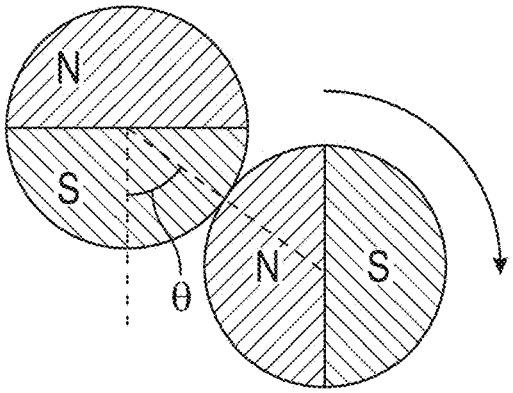
Figure 15C:
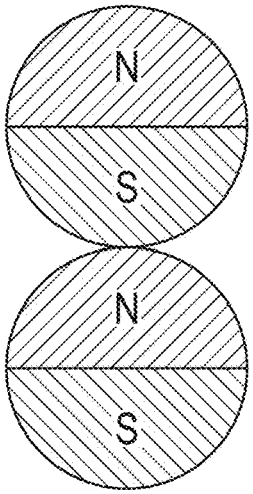
Figure 16A:
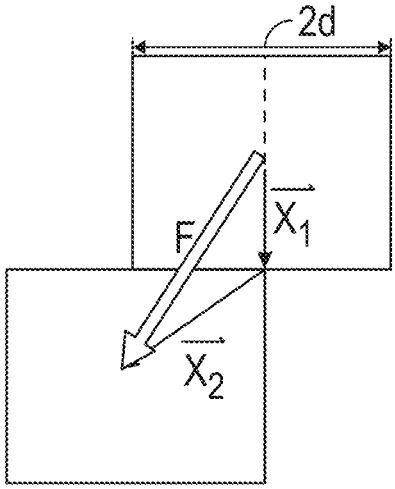
FIGS. 16A-16C are schematic views illustrating cooperation between elements employing a bar and cam design, as shown in FIG. 5A and FIG. 5B, in various positions.
Figure 16B:
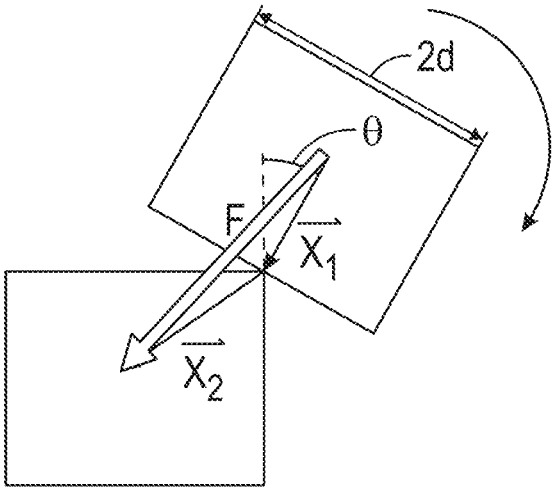
Figure 16C:
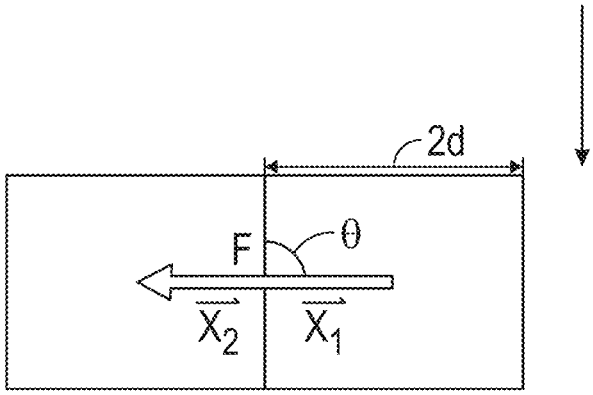
Figure 17:
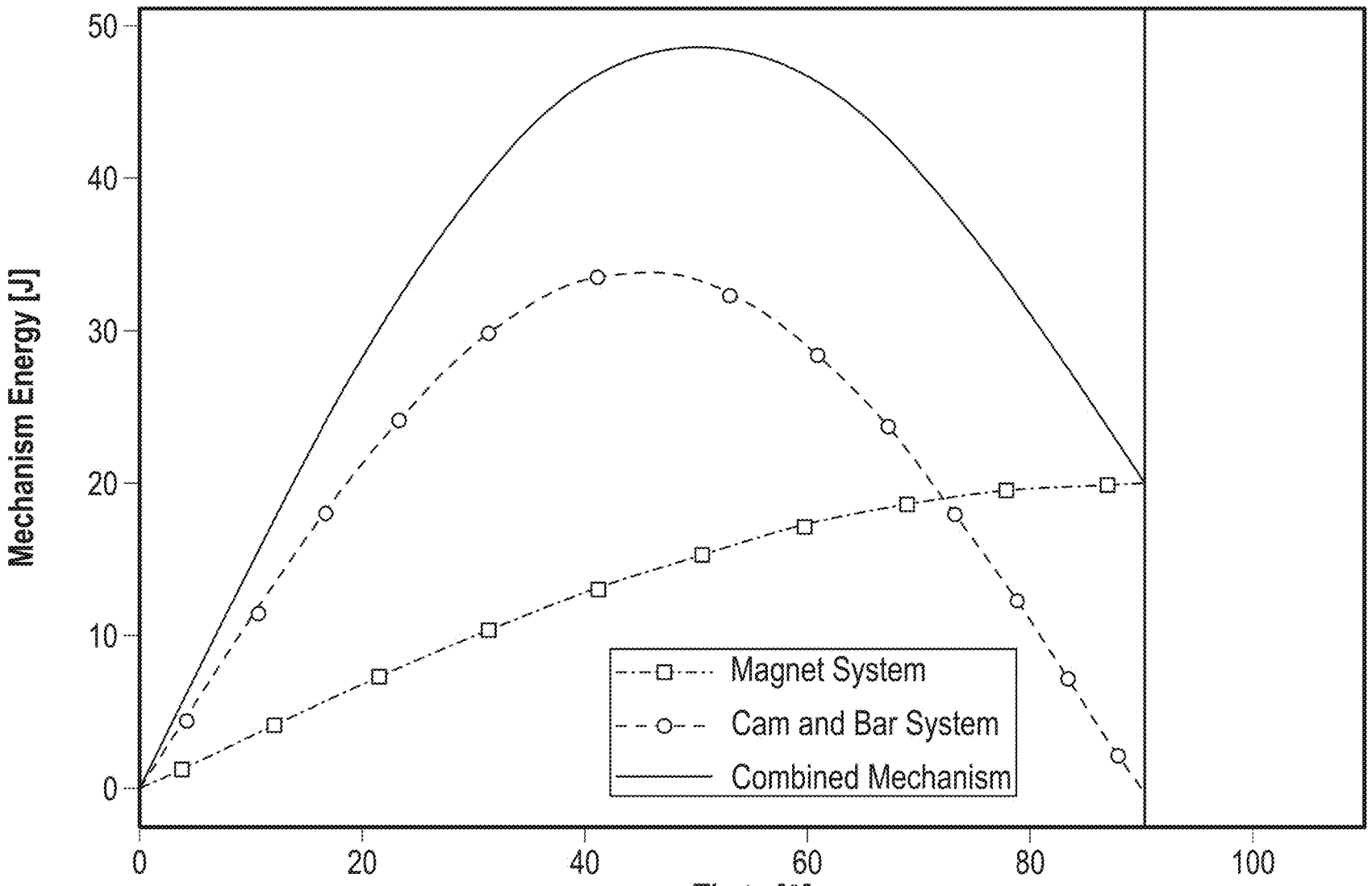
FIG. 17 is a graphical representation showing stored energy versus position for the magnet arrangement shown in FIGS. 15A-C, FIGS. 16A-C and for a combination thereof.

In developing the actuator, two bistable mechanisms were explored: one utilizes strain energy and cam shape, the other utilizes diametrical magnets. A final mechanism employs both magnets and strain energy to produce enough rotational energy for consistent actuation while minimizing the actuator geometry. Each mechanism is characterized by its rotational energy well. By determining the energy required to rotate the mechanism into its unstable equilibrium, the amount of rotational energy released by the mechanism during actuation can be determined. The energy wells were derived by modeling the mechanism torque as a function of theta. Semi-static free-body diagrams of the mechanism's internal forces were used for this derivation, as shown in FIGS. 15A-15C (for diametrical cylindrical magnets) and FIGS. 16A-16C (for cam design). The torque function was then numerically integrated over 90° of motion to find the mechanism energy as a function of theta. The resulting function is shown in FIG. 17.

The cam and bar system employs strain energy to create stable positions at increments of 90°. The cam shape interacts with the bar, approximated as a spring, causing an energy well peak at 45° when the bar is extended to its fullest. From 45° to 90°, the cam and bar system maintains a constant pivot, so the torque can be calculated based on free body diagrams at that point. The length and direction of the spring are calculated by adding the vectors $\vec{x}_1$ and $\vec{x}_2$ shown in FIGS. 16A-16C and calculating their magnitudes:

$$|\vec{x}| = |\vec{x}_1 + \vec{x}_2| = \sqrt{(d + d\ \sin(\theta))^2 + (d + d\ \cos(\theta))^2}, \tag{1}$$

The torque was then calculated through the cross product of the spring force vector with $\vec{X}_1$ and is referenced as $\tau_1$:

$$\tau_1(\theta) = dk\ \sin(\theta)(|\vec{x}| - 2d)\frac{d + d\ \cos(\theta)}{|\vec{x}|} - dk\ \cos(\theta)(|\vec{x}| - 2d)\frac{d + d\ \sin(\theta)}{|\vec{x}|}, \tag{2}$$

where from Hooke's law:

$$k = \frac{EA}{2d}. \tag{3}$$

As the cam rotates from 45° to 0°, it undergoes both sliding and rotation, making the energy much more difficult to calculate. However, because the locations of local minima and maxima are more indicative of the mechanism actuation, and those positions are known from the earlier torque analysis, it is assumed that the energy well for this mechanism is symmetric about 45°. During deployment from 45° to 0° the energy is released as the cam begins to slide, the strain in the bar decreases, and the band actuates.

A bistable mechanism using diametrically magnetized rings was previously conceptualized. As the rotating magnet moves θ, its poles rotate 2θ. The general shape of the torque $\tau_1$ as a function of theta is known based on intuition and the state of the art. Further modeling and torque testing may be done to better understand the magnitude of the torque function, but for the purpose of understanding the bistability of the magnets, a sinusoidal approximation of the mechanism torque $\tau_2$ is sufficient:

$$\tau_2 = F_{max}\sin(\theta) \tag{4}$$

The torque is then integrated over the full 90° of motion to find the mechanism's energy well shown in FIG. 17.

Both the mechanisms have strong bistability. However, the magnets, when embedded in cams for prototyping, lose energy to slippage as the actuator radius is not fixed. The cam and bar system has this fixed radius but loses bistability quickly as plastic deformation can easily occur without an additional compressive force in the stable position. To stabilize the system for effective actuation and maximize the mechanism's durability, both the bar and magnet systems were combined to create a new mechanism that is bistable over 90° and usable in a watchband. The released energy of this mechanism is calculated by combining the rotational energy of both the magnets and the bar, obtained by integrating their torque functions over their applicable range.

$$E = \int_0^{90} \tau_1(\theta) + \int_0^{90} \tau_2(\theta) \tag{5}$$

As seen in FIG. 17, the combined mechanism has two stable positions at 0° and 90°. The position of the unstable equilibrium varies as the magnitudes of the bar and magnet system change with respect to one another. As the energy of the bar system increases in magnitude, the unstable position of the combined mechanism shifts closer to 45°. The magnet system has the reverse effect, instead moving the unstable position closer to 90°. The nature of the cam creates a hard stop represented in FIG. 17 as a vertical line.

The combined mechanism was integrated into a watchband to create an accessible watchband with stable open and closed positions. This allows for a "hands-free" don mechanism. Images showing actuation of a watchband that combines the bar and magnet mechanisms are shown in FIGS. 5A and 5B. Because this mechanism provides passive bistability, it can be beneficial in applications where light-weight or energy-efficient mechanisms are necessary. These fields include, but are not limited to, other biomedical devices, deployable structures, and robotics.

Figure 18:
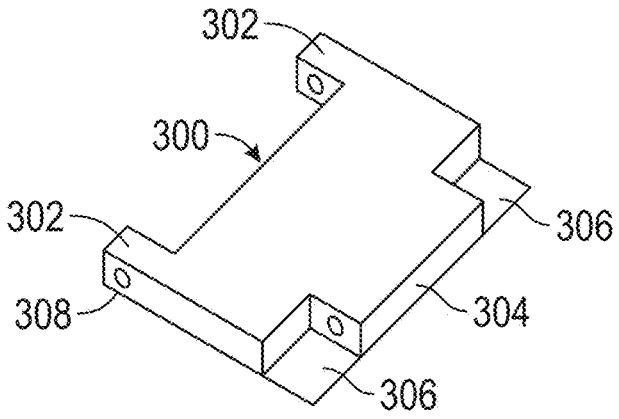
FIG. 18 is an isometric side view of a passive link that may be used in conjunction with the links illustrated in FIG. 5A and FIG. 5B to define a band.

Turning now to FIG. 18, shown is an exemplary passive link (300) that may be used in conjunction with the bistable compliant links in accordance with the present invention in order to define a band, such as a watch band or the like.

As is common, each passive link (300) may comprise a first end comprising a pair of legs (302) extending therefrom adjacent to the edges thereof, along with a second end having a middle portion (304) extending therefrom, which is sized and shaped so as to be disposed between the legs (302) defined on the first end of an adjacent passive link. Corresponding holes are provided in the legs (302) and the middle portion (304) in order to receive pins or the like (not shown) so as to pivotably connect adjacent passive links together. Since such arrangements of links are extremely well know, this aspect of the passive links (300) is not described in more detail.

What separates passive links (300) in accordance with the present invention from commonly known passive links, however, is the provision of a pivot stop ledge (306) extending from the second end of the link (300) on either side of the middle portion (304). The pivot stop ledge (306) is sized and shaped to cooperate with a corresponding surface (308) of the pair of legs (302), as best seen in FIG. 19A and FIG. 19B.

Figure 19A:
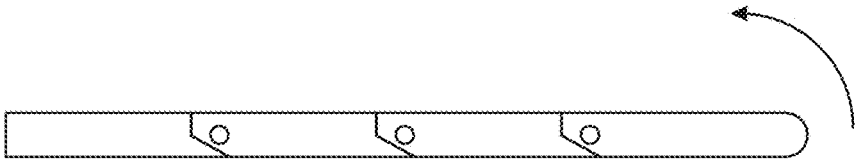
FIG. 19A and FIG. 19B are side elevational views of bands including a plurality of the passive links shown in FIG. 18, shown in open and closed positions, respectively.
Figure 19B:
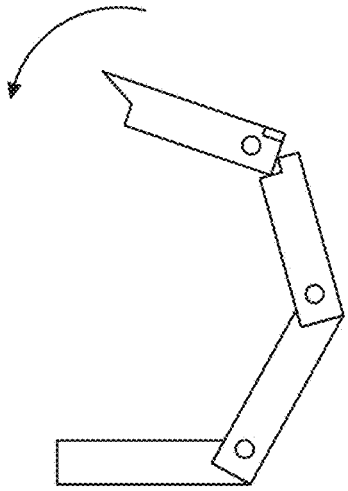

More specifically, as best seen in FIG. 19A, when the passive links (300) are disposed in a generally flat arrangement (considered to be a fully open position), engagement between the pivot stop ledge (306) and the corresponding surfaces (308) of the legs (302) prevent any further pivoting between the links, such that only pivoting in the direction of the arrow is possible). Such pivoting is illustrated in FIG.

19B. This "hard stop" feature of the passive links helps to facilitate hands-free donning of the band be ensuring the passive links do not pivot back on themselves past a rotational position that is useful.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A band configured to wrap around and be secured to an object, said band comprising:

at least three members pivotably connected to one another so as to be pivotable with respect to each other between an open position and a closed position, the first member comprising an outwardly disposed face defining an imaginary plane and each of the second and third members comprising an actuator prong that extends outwardly beyond the imaginary plane when the second and third members are in the open position and that is retracted to no longer extend outwardly beyond the imaginary plane when the second and third members are in the closed position;

wherein the first and second members are configured such that when the first and second members are pivoted with respect to each other past a threshold position toward the closed position, the first and second members are biased toward the closed position by biasing forces created by at least one permanent magnet disposed on at least one of the first and second members and when the first and second members are pivoted with respect to each other past the threshold position toward the open position, the first and second members are biased toward the open position by biasing forces created by the at least one permanent magnet disposed on at least one of the first and second members;

wherein the first and third members are configured such that when the first and third members are pivoted with respect to each other past a threshold position toward the closed position, the first and third members are biased toward the closed position by biasing forces created by at least one permanent magnet disposed on at least one of the first and third members and when the first and third members are pivoted with respect to each other past the threshold position toward the open position, the first and third members are biased toward the open position by biasing forces created by the least one permanent magnet disposed on at least one of the first and third members; and wherein movement of the object into contact with the first member so as to exert actuation forces toward the outwardly disposed face when the actuator prongs of the second and third members are in contact with a surface causes the second and third members to move from the open position to the closed position due to forces created between the actuator prongs and the surface.

2. The band of claim 1:

wherein the at least one permanent magnet disposed on at least one of the first and second members and the at least one permanent magnet disposed on at least one of the first and third members comprise a first permanent magnet and a second permanent magnet disposed at opposite ends of the first member, a third permanent magnet disposed on the second member and a fourth permanent magnet disposed on the third member;

wherein the biasing forces biasing the first and second members toward the closed position and biasing the first and second members toward the open position are created by the first and third magnets; and wherein the biasing forces biasing the first and third members toward the closed position and biasing the first and third members toward the open position are created by the second and fourth magnets.

3. The band of claim 2 wherein each of the first, second, third and fourth magnets comprises a diametrically magnetized magnet.

4. The band of claim 3 wherein each of the first, second, third and fourth magnets is configured as a rectangular prism.

5. The band of claim 3 wherein each of the first, second, third and fourth magnets is configured as a cylinder.

6. The band of claim 1, wherein the second and third members are pivotably connected to the first member at opposite ends thereof.

7. The band of claim 6, wherein the first member comprises a watch body and the outwardly disposed face comprises a watch face, wherein the second member comprises a first watch strap, and wherein the third member comprises a second watch strap, whereby the band comprises a watch.

8. The band of claim 1 further comprising a closure affixing the second member and the third member together when the second and third members are in the closed position.

9. The band of claim 8 wherein the closure comprises a magnetic closure.

10. The band of claim 1 wherein at least one of the second member and the third member comprises a flexible material.

11. The band of claim 1 wherein at least one of the second member and the third member comprises a plurality of links.

12. The band of claim 11 wherein at least some of the plurality of links comprise bistable compliant links.

13. The band of claim 11 wherein at least some of the plurality of links comprise passive links.

14. The band of claim 11 wherein the plurality of links comprise a combination of bistable compliant links and passive links.

15. The band of claim 1, wherein the open position and the closed position comprise stable positions such that the open position and the closed position are maintained without external forces being applied thereto.

16. The band of claim 15, wherein rotational positions of the first and second members with respect to each other and rotational positions of the first and third members with respect to each other between the open position and the closed position comprise unstable positions.

17. The band of claim 1:

wherein the first member comprises a first planar surface and a second planar surface at a first end thereof, the first and second planar surfaces defining an angle therebetween;

wherein the first member comprises a third planar surface and a fourth planar surface at a second end thereof, the third and fourth planar surfaces defining an angle therebetween;

wherein the second member comprises a planar surface;

wherein the third member comprises a planar surface;

wherein the planar surface of the second member abuts the first planar surface of the first member when in the open position and the planar surface of the second member abuts the second planar surface of the first member when in the closed position; and wherein the planar surface of the third member abuts the third planar surface of the first member when in the open position and the planar surface of the third member abuts the fourth planar surface of the first member when in the closed position.

18. The band of claim 17 wherein the angle between the first and second planar surfaces of the first member is 90 degrees and the angle between the third and fourth planar surfaces of the first member is 90 degrees.

19. The band of claim 1 further comprising:

a first pivot element configured to allow the first and second members to pivot with respect to one another, while preventing the first and second members from separating; and a second pivot element configured to allow the first and third members to pivot with respect to one another, while preventing the first and third members from separating.

20. A band configured to wrap around and be secured to an object, said band comprising:

at least three members pivotably connected to one another so as to be pivotable with respect to each other between an open position and a closed position, the first member comprising an outwardly disposed face defining an imaginary plane and each of the second and third members comprising an actuator prong that extends outwardly beyond the imaginary plane when the second and third members are in the open position and that is retracted to no longer extend outwardly beyond the imaginary plane when the second and third members are in the closed position;

wherein a first member of said at least three members comprises a first diametrically magnetized magnet and a second diametrically magnetized magnet disposed at opposite ends thereof, wherein a second member of said at least three members comprises a third diametrically magnetized magnet and wherein a third member of said at least three members comprises a fourth diametrically magnetized magnet;

wherein the first and second members are configured such that when the first and second members are pivoted with respect to each other past a threshold position toward the closed position, the first and second members are biased toward the closed position by forces created by the first and third magnets and when the first and second members are pivoted with respect to each other past the threshold position toward the open position, the first and second members are biased toward the open position by forces created by the first and third magnets;

wherein the first and third members are configured such that when the first and third members are pivoted with respect to each other past a threshold position toward the closed position, the first and third members are biased toward the closed position by forces created by the second and fourth magnets and when the first and third members are pivoted with respect to each other past the threshold position toward the open position, the first and third members are biased toward the open position by forces created by the second and fourth magnets; and wherein movement of the object into contact with the first member so as to exert actuation forces toward the outwardly disposed face when the actuator prongs of the second and third members are in contact with a surface causes the second and third members to move from the open position to the closed position due to forces created between the actuator prongs and the surface.

* * * * *